US008734159B2

(12) United States Patent
DeStefano

(10) Patent No.: US 8,734,159 B2
(45) Date of Patent: May 27, 2014

(54) PHYSICAL SKILLS TRAINING APPARATUS AND METHOD

(75) Inventor: Peter W. DeStefano, Ithaca, NY (US)

(73) Assignee: Cornell University, Ithaca, NY (US)

( * ) Notice: Subject to any disclaimer, the term of this patent is extended or adjusted under 35 U.S.C. 154(b) by 796 days.

(21) Appl. No.: 12/787,615

(22) Filed: May 26, 2010

(65) Prior Publication Data

US 2011/0294101 A1 Dec. 1, 2011

(51) Int. Cl.
*A63B 69/00* (2006.01)
*A63B 69/34* (2006.01)

(52) U.S. Cl.
USPC ..... 434/251; 473/444

(58) Field of Classification Search
USPC ..... 434/247, 251, 392; 482/83, 88; 473/444
See application file for complete search history.

(56) References Cited

U.S. PATENT DOCUMENTS

| | | | | | |
|---|---|---|---|---|---|
| 2,526,217 | A * | 10/1950 | Gilman | 473/444 |
| 2,956,616 | A * | 10/1960 | Labusky et al. | 482/69 |
| 3,250,533 | A * | 5/1966 | Nicholson | 482/83 |
| 4,211,402 | A * | 7/1980 | Carroll | 482/139 |
| 4,515,364 | A * | 5/1985 | Rotella | 482/139 |
| 5,009,414 | A * | 4/1991 | Bass | 482/83 |
| 5,501,649 | A * | 3/1996 | Queppet | 482/88 |
| 5,643,154 | A * | 7/1997 | Awbrey et al. | 482/111 |
| 5,741,970 | A * | 4/1998 | Rubin | 73/379.05 |
| 7,056,238 | B1 * | 6/2006 | Brown | 473/444 |
| 7,131,917 | B2 * | 11/2006 | Spencer | 473/444 |
| 7,658,696 | B2 * | 2/2010 | Hunter | 482/10 |
| 8,231,511 | B2 * | 7/2012 | Dalcourt | 482/106 |
| 2003/0216228 | A1 * | 11/2003 | Rast | 482/84 |
| 2004/0082445 | A1 * | 4/2004 | Zabel | 482/109 |
| 2007/0275838 | A1 * | 11/2007 | Neave | 482/139 |
| 2008/0098797 | A1 * | 5/2008 | Considine et al. | 73/12.09 |

OTHER PUBLICATIONS

RAE Crowther Co. Football and Strength Equipment; www.raecrowther.com; 800-841-5050; Winter/Spring 2008; cover of catalog, 34-35, 39-40.

* cited by examiner

*Primary Examiner* — Gene Kim
*Assistant Examiner* — Alyssa Hylinski
(74) *Attorney, Agent, or Firm* — William Greener; Bond, Schoeneck & King, PLLC

(57) ABSTRACT

A physical skills training apparatus particularly useful for training various close-contact sports skills and techniques related to stance, balance, hand positioning accuracy, leg movement, muscle strength, action and reaction times, resistance, movement finesse, and others, includes a main structure or body that provides at least geometric form, structural integrity, engageability by at least one user if the apparatus is connected to a mount or support and, by two or more users (as, e.g., opposing participants), and is characterized by its geometric form to be portable, relatively light-weight, and easily transportable by a single person. Illustratively, the main body of the apparatus may be in the form of a one-piece, high aspect ratio plate that is flat or curved. The main body will have (holding) means for gripping, grasping or holding the apparatus by a user on one side of the apparatus, which may be in the form of shaped and oriented openings to accommodate both hands of a user, or handles. There may be more than two of the openings or more than two sets of the openings to facilitate different holding positions by a single user if the apparatus is mounted or, by two simultaneous users, one on each of the front side and the back side of the apparatus. Training methods are disclosed.

18 Claims, 8 Drawing Sheets

PHYSICAL SKILLS TRAINING APPARATUS AND METHOD

RELATED APPLICATION DATA

N/A.

GOVERNMENT SPONSORSHIP

N/A.

BACKGROUND

1. Field of the Invention

Embodiments of the present invention are directed to apparatus and methods including the use of such apparatus, in the field of physical skills training such as, but not limited to, sports skills More particularly, the embodied apparatus and methods may be used for training certain sports skills such as, but not limited to, proper body position and leverage techniques that are useful in sports games including, but not limited to, football, wrestling, and jujitsu, for example. The embodied apparatus and methods may also be used to train muscles and develop other physical attributes that are involved with a particular sport skill such as, but not limited to, blocking techniques used in the game of football and wrestling and martial arts techniques, for example, as well as for physical therapy-related activities and the like.

2. Description of Related Art

One needs only do an Internet search pertaining to, e.g., football training equipment to find myriads of products for teaching and/or training speed, agility, balance, strength, reaction time, technique, and so on. Apparatus and methods include padded blocking sleds and wheel trainers, chutes, steppers, ladders, fixed and hand-held dummies, reactors, stabilizers, parachutes, weighted footballs, elastic cords, how-to videos, and many more.

What appears to be missing are apparatus and methods particularly directed to training close contact skills and techniques that might be useful, for example, for football linemen (particularly defensive), sumo wrestlers, jujitsu opponents, and others where stance, balance, hand position and positioning accuracy, leg movement, muscle strength, action and reaction time, movement finesse, and other attributes that can be critically successful or unsuccessful.

Accordingly, the inventor has recognized a need for, as well as the benefits and advantages of, sports skills training apparatus and methods that can be used by one or two or more individuals to train these attributes. The benefits and advantages extend to apparatus and methods that are portable, which can be used by people over wide age and ability ranges (e.g., children to professional athletes), which can be customized for identification and sponsorship, which may easily be transported by a single individual, and which may effectively compliment or replace existing apparatus and methods that may be less effective or non-specific in purpose.

SUMMARY

A most general embodiment of the invention is a device/apparatus that is particularly suited for use to train various close-contact sports skills and techniques related to stance, balance, hand position and positioning accuracy, leg movement, muscle strength, action and reaction time, resistance, movement finesse, and others. The sports skills intended to be trained are generally directed to two opposing, engaging participants such as would be illustratively and by non-limiting examples used by opposing offensive/defensive football players, wrestlers, jujitsu opponents, and others, however, the apparatus may effectively be used by one or more than two persons. Moreover, because of the skill sets addressed by the embodied apparatus and methods, their application may well extend into the field of physical therapy or the like for training and rehabilitation unrelated to sports skills per se.

Accordingly, the apparatus will include a main structure or body that provides at least geometric form (e.g., size, shape, weight), structural integrity (e.g., completely rigid, partly flexible, twistable, etc.), engageability by at least one user; for example, a weighted device may be held by a single user to use in a certain prescribed manner or, alternatively, if device may be connected to a mount or support or, by two or more users (e.g., opposing participants), and is characterized by its geometric form to be portable and easily transportable by a single person. As such, the main body of the apparatus may be in the form of a one-piece, high aspect ratio plate-type geometry (i.e., length and width or diameter much greater than thickness) that can be flat or curved, with parallel or non-parallel or, concentric or non-concentric, opposing surfaces, or multiple connected body sections. The footprint of the main body may be square, rectangular, round, oval, custom, or free-form. The main body will have (holding) means for gripping, grasping or holding the apparatus by a user on one side of the apparatus, which may be in the form of shaped and oriented openings to accommodate both hands of a user, or handles. There may be more than two of the openings or more than two sets of the openings to facilitate different holding positions by a single user or, by two (or more) simultaneous users, one on each of the front side and the back side of the apparatus. Advantageously, the holding means may be shaped, sized, oriented, and/or positionally located 'correctly'; i.e., in such a way as to train a user's arm/hand positioning for the desired skill being trained; for example, the 'perfect position' for a football defensive lineman has the elbows close to the chest and the hands at proper spacing to effect leverage and various motion vectors to effectively displace an offensive opponent. Use of the embodied apparatus having holding means that require a particular arm/hand positioning for proper use of the apparatus will help to train an effective blocking skill.

A two-piece plate-type body may be interconnected by two or more handles, which may have particular shapes, sizes, and orientations, and which may be fixed or movable. Each left- and right-hand holding means and/or sets of holding means will advantageously be positioned on opposite sides of a vertical centerline of the apparatus.

Alternatively, the main body may be of a hollow tubular or solid bar or beam construction in the non-limiting, exemplary shape of a "U" or a horseshoe, or other ergonomic curvature. Opposing regions of the body may be marked or otherwise identified as gripping, grasping or holding regions for one, two, or multiple simultaneous users. Alternatively, the main body may be in the form of a single or multiple-piece straight bar or beam having two or more sets of handles or gripping, grasping or holding regions for use by two simultaneous users. The handles may have particular shapes, sizes, and orientations and, may be fixed or movably positionable. According to a non-limiting aspect, a solid or connecting shaft structure could be used to allow twist action and beam flexure modes. The main body could be made as a graduated substructure to change flexure vs. position.

The various aspects of the apparatus just described may be made of Plexiglas™ or other suitable plastic material, steel or other appropriate metal, elastomeric material, or a composite depending upon the desired rigidity, strength, flexion, weight, durability, and other practical attributes of the apparatus. The apparatus may be 'weighted' to make its use more appropriate to a particular user group; e.g., lighter for a younger/child user and heavier for a larger, stronger user. Furthermore, the apparatus may be unevenly weighted such that when held in one orientation it is effectively used to train a 'left-directed' skill and when flipped or oriented differently, it can effectively be used to train a 'right-directed' skill.

According to an aspect, the apparatus may include one or more accelerometers, sensors, transducers (e.g., force, motion), strain gauges, buckle torque joints, all hereinafter referred to generally as 'sensors,' and/or wireless (RF) transmitters/receivers, to enable the apparatus to transmit and collect data indicative of force, torque, motion, velocity, time, acceleration, direction vectors, and other parameters useful for evaluating the skills desired to be trained. In a non-limiting, exemplary aspect, the device may be mounted to a support for use by, e.g., a single user, or used unattached by a single user. The device may or may not include 'passive' sensors (i.e., accelerometers or the like that can detect force, motion, and so on). Alternatively, the device may further be equipped with 'active' sensors, e.g., programmable force transducers located, for example, at selected points on the body of the apparatus. A calibrated force F1 could be provided by the transducer, to which a user would respond with a force F1'. A sensor measuring the response force F1' may further be coupled to an indicia (e.g., LED, pressure-sensitive material, others) on the apparatus that would indicate whether the response force is in a pre-determined value range appropriate to the sports skill being trained. The force F1 may initially be provided over a relatively longer time duration, t1, to train the response force by the user, and subsequently applied over relatively shorter and shorter time intervals, tn, until both the force F1 and the response force F1' are modeling actual real-time forces and responses. This data could also be transmitted to a processing and display device (e.g., PDF, notebook computer, iPad™ computer, etc.) for follow-up analysis.

In a non-limiting, exemplary aspect the main body of the apparatus may be a flexible material having a degree of compliance sufficient to simulate human body flexibility, and extend the range of flex to allow sets of muscles to be exercised over a range of motion/force. Various shapes of the holding means may be used for hand contact points for taped or non-grabbing fingers of a user. The holding means may have changeable hand angles in both vertical and horizontal orientations to simulate taller/shorter and wider/narrower users and still provide for proper arm/hand positioning for the physical skill being trained.

According to another non-limiting, exemplary aspect, the main body of the apparatus may comprise a film, coating, tape, or other attribute that changes color in proportion to an applied force or strain.

A method embodiment of the invention for training physical skills involves the steps of providing a physical skills training apparatus as described above and embodied herein; engaging the apparatus by both hands of a first user holding the apparatus; engaging the apparatus by at least one hand of a second user while the apparatus is engaged by the first user; and directing the apparatus movement by the respective first or second user to train the respective second or first user's response according to a particular skill. Alternatively, the apparatus may be mounted to a wall or other support structure in a stationary or moveable manner. One or more users being trained could exert force on the apparatus, which may be directed to a particular region, performed over a given time interval, or otherwise per the particular skills training. The mounted device may or may not include indicia to indicate a particular contact by the user. Such indicia may include, but is not limited to, a pressure sensitive medium applied to the apparatus, a 'passive' sensor (as referred to above), or others known in the art. In a further alternative aspect, such an apparatus including the aforementioned indicia may be controlled by physical means of a trainer-user in conjunction with a trainee-user, rather than being mounted to a support. In a further alternative aspect, the device or apparatus could be weighted in a particular manner and used by a single user to practice a particular skill associated with a particular motion, for example. In any event, the method involves providing an apparatus having holding means that position a trainee-user's hands on the apparatus in a 'correct' manner for a particular physical skill being trained, moving the apparatus in a desired way, and eliciting a 'correct' response from the trainee-user due at least in part to the constraints placed on the trainee-user due to the characteristics of the holding means.

A non-limiting, exemplary physical skills training method embodiment involves the steps of providing a physical skills training apparatus as described herein that is movably mounted to a support and, which may include one or more 'passive' sensors (as referred to above) in the non-limiting, exemplary form of accelerometers, strain gauges, etc. and/or one or more 'active' sensors (as referred to above) in the non-limiting, exemplary form of variable-force-producing components engaged with the back-side of the apparatus, as well as signal transmitter/receiver components as appropriate; engaging a user with a front-side of the apparatus; instructing the one or more variable force-producing components to apply a first given force over a first given period of time; detecting a first response force by the user; determining whether the response force by the user meets a predetermined criteria and, if no, repeating the aforementioned process or ending the process; otherwise, instructing the one or more variable force-producing components to apply another given force that is greater than the first given force over a second given period of time that is equal to or less than the first given period of time; detecting a second response force by the user; determining whether the second response force by the user meets a predetermined criteria and, if no, repeating these process steps or ending the process; otherwise, iterating the process with further increased forces and shorter periods of time to train a desired user response with the apparatus.

Additional features and advantages of the invention will be set forth in the detailed description which follows, and in part will be readily apparent to those skilled in the art from that description or recognized by practicing the invention as described herein, including the claims as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF EXEMPLARY EMBODIMENTS OF THE INVENTION

Reference is made below to the accompanying drawings, briefly described above, which show by way of illustration non-limiting, exemplary embodiments and aspects of the invention.

Figure 1:
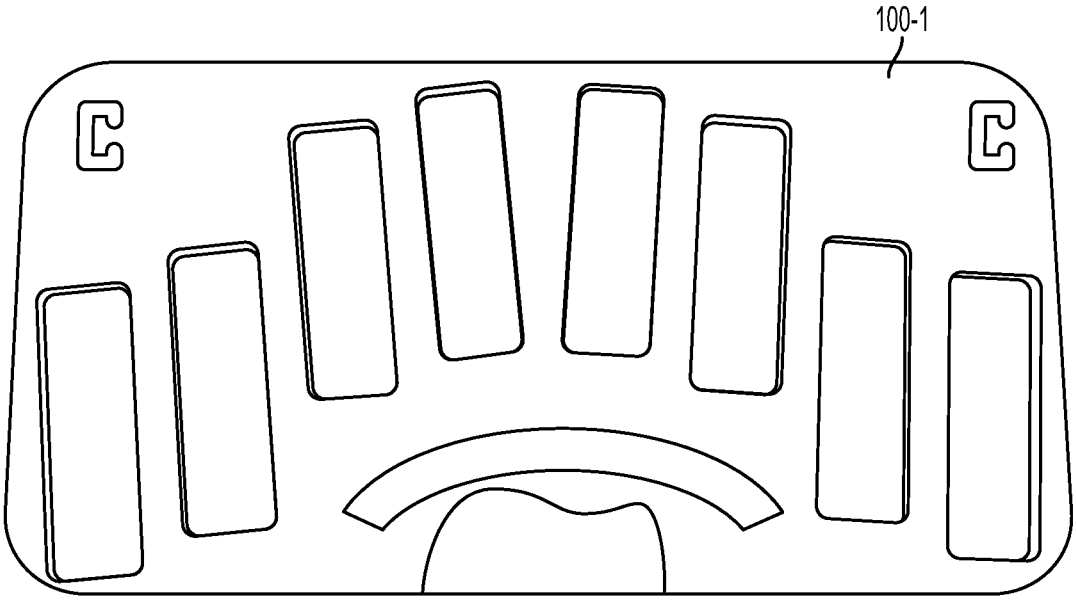
FIG. 1 shows a front elevational view of a sports skills training apparatus showing the arrangement of four sets of holding means according to a non-limiting, illustrative embodiment of the invention.
Figures 2A, 2B:
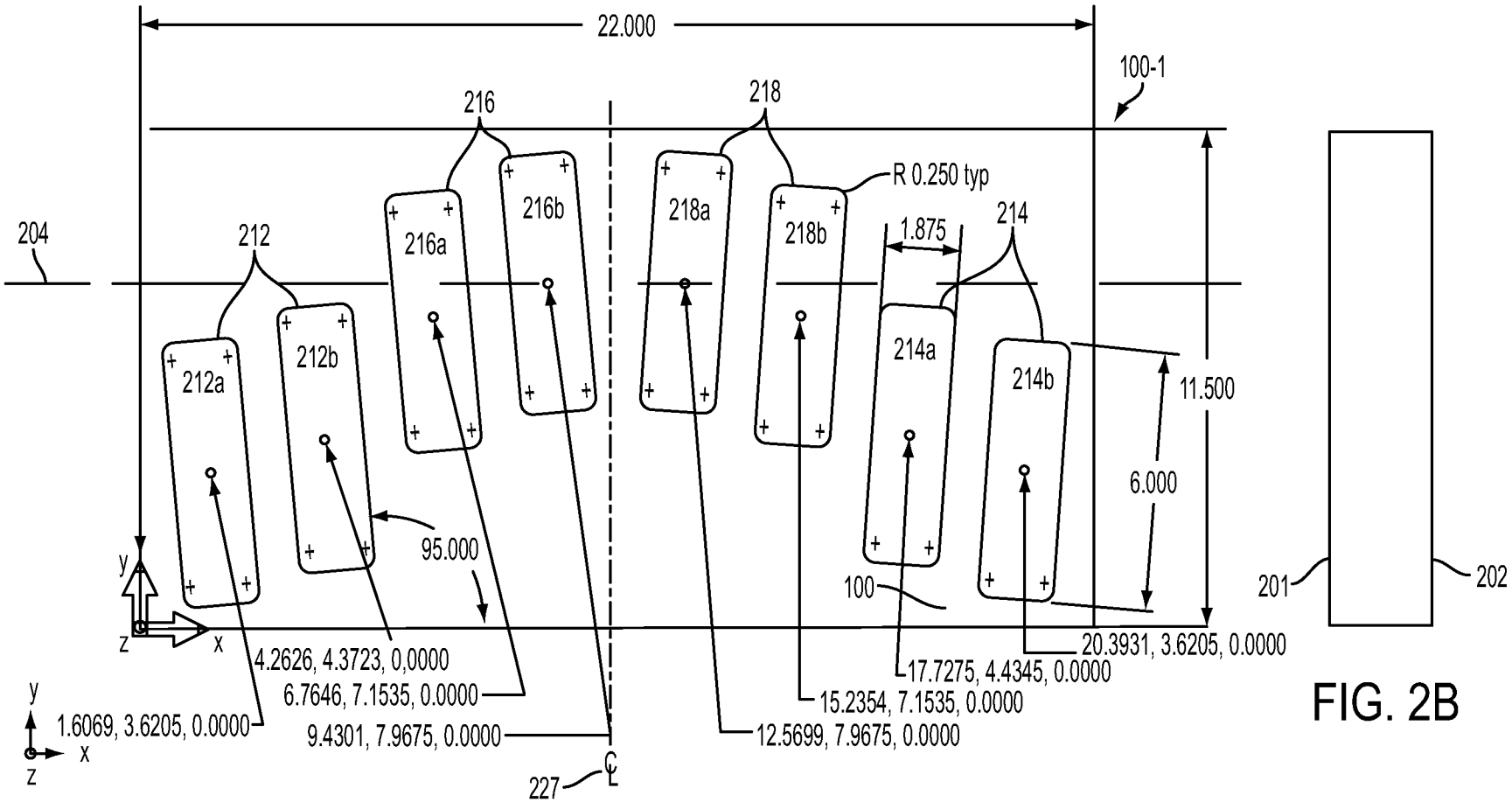
FIGS. 2*a*, 2*b*, respectively, show a is a front elevational view CAD/CAM drawing showing dimensional details of the apparatus shown in FIG. 1 and a side view, according to a non-limiting, illustrative embodiment of the invention.

FIGS. 1 and 2*a*, 2*b* show an exemplary embodiment 100-1 of the invention, which includes a main body 100 in the form of a relatively flat plate having parallel front-side and back-side surfaces, 201, 202, respectively, and a longitudinal orientation axis 204 that indicates the general orientation of the apparatus during use. Alternatively, the body could have a curvature in the x-y plane.

As shown, the main body includes holding means for gripping, grasping or holding the apparatus by both hands of a first user from either the front-side 201 or the back-side 202 of the main body. The holding means are illustrated by four sets 212, 216, 218, 214 of thru-openings wherein each set includes two respective openings 212*a*, 212*b*; 216*a*, 216*b*; 218*a*, 218*b*; 214*a*, 214*b*. Each one of the complimentary sets of openings 212, 214 and 216, 216 are located on opposite sides of the orientational vertical centerline 227 of the apparatus. As further shown, the openings are in the form of generally vertically-oriented elongate slots that are at a relatively small angle with respect to the vertical centerline and, which are oriented generally parallel to each other for the purposes of both comfort and functional advantage. According to an aspect, the first and fourth hand holds 212, 214 and the second and third hand-holds 216, 218 are located at the same relative positions on both sides of the centerline 227.

A first user may hold the apparatus via sets 212 and 214, and a second, simultaneous user may then grasp the apparatus via sets 216, 218. Illustratively, a first user's hand goes through one slot and the fingers wrap around into the adjacent slot so that the user can have a firm grip on the apparatus and can exert force against another user holding the apparatus from the opposite side. Opposing forces can be exerted by the two users with the first user having his right hand going through set 214 and his left hand going through set 212, while the other user will have his right hand going through set 216 and his left hand going through set 218. This positioning may likely train muscular development and footwork skills.

Alternatively, a first user may grip the apparatus with her left and right hands by holding sets 216, 218, respectively, while a second user grips the apparatus with her left and right hands via sets 214, 212, respectively. In this manner the first user may intend to move forward while the second user moves rearward. In this configuration, both users may be exerting the types of forces used during a particular sport and the muscles of both users may be trained.

In another use configuration, a first user may have has his hands going through the first and third holding sets 212, 218, while the second user has his hands going through the second and fourth gripping areas 216, 214, respectively. In this configuration, the users may be exerting force against one another as in the previously described configuration, but instead of moving predominately forwardly and rearwardly they may be moving laterally or sideways, again with the intent of training certain muscles and responses.

In the exemplary embodiment shown in FIG. 1, the apparatus is constructed of Plexiglas material about 0.5 to 0.75 inch (in) thick, thus the main body is substantially rigid in use. As illustrated in FIG. 2*a*, the main body has a longitudinal (x-direction) dimension of about 24 in and a width (y-direction) of about 12 in. The openings for holding the apparatus are nominally about 6 in×about 2 in, but will be sized accordingly to accommodate hand and finger sizes of various user age groups as well as gloved or taped hands/fingers. The solid regions between each of the openings may have rounded edges or be otherwise contoured for comfort and may be padded or otherwise textured.

Other materials may be used for the main body. For example, the main body could be made of an elastomeric or composite material that would provide the apparatus with a degree of resilience and flexibility depending upon material and dimensional parameters. It may be advantageous to give the apparatus a feel akin to the pliancy of a real opponent in a given situation (e.g., player wearing football pads).

In an alternative aspect, the main body 100 may have only a single set of two holding openings in selected regions of the main body, thus leavening more uninterrupted portions of the main body surfaces whereupon a second user may exert force without grasping the apparatus. This aspect may be used to train certain pushing, shoving, and balance skills.

Figure 3:
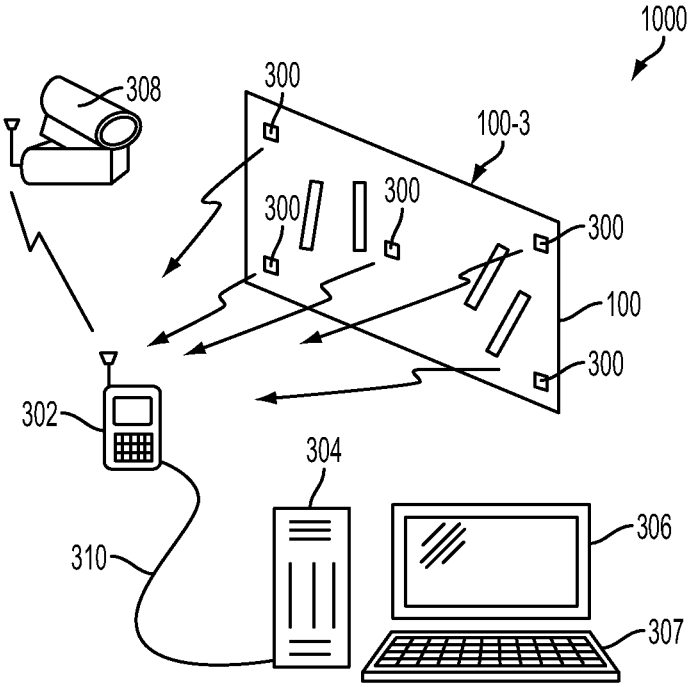
FIG. 3 shows a schematic view of a system including a sports skills training apparatus with mounted sensors and supporting recording and processing equipment, according to an exemplary embodiment of the invention.

According to a non-limiting aspect of the embodied invention, the apparatus 100-3 may further include one or more sensors 300 engaged with the main body, as illustrated in FIG. 3, which shows sensors disposed at four respective corner regions and a center region of the main body on either the back-side or the front-side surfaces or both.

As embodied herein and further depicted in FIG. 3, a sports training data capture system 1000 employing the sports training apparatus 100-3 is disclosed. The sports training data capture system includes a plurality of inertial sensor devices 300 disposed at various locations on the training apparatus 100-3. Each inertial sensor device (ISD) 300 measures the time evolution, magnitude, and direction of the forces and the motion (pitch, roll, and yaw) at each location on the apparatus. In the field, the system 1000 may be controlled by a personal data assistant (PDA) 302 via an RF link. The system 1000 may include an optional video recorder 308 that is also controlled by the PDA 302. In another alternate embodiment, apparatus 100-3 may be extended to include ISDs 300 mounted on other locations on the body of the user. For example, if the apparatus is being used to train an offensive tackle (American football), the position and movement of the player's feet, trunk, etc. during the training drills will provide important data relative to the technique being employed by the player during the drill.

At the beginning of a training session, each ISD 300 is initialized by the PDA 302. During the session each ISD 300 will record the forces applied to apparatus 100, as well as the motion of each ISD, as a function of time. The data is transmitted in real-time, or in near real time, to the PDA 302 via the RF link. If the optional video recorder is employed, the PDA 302 is configured to provide both the video recorder 308 and each ISD 300 with periodic timing and synchronization information during the training session.

A computing device 304, which includes display 306, is also shown in FIG. 3. Those of ordinary skill in the art will appreciate that the computer 304 may be employed in an off-the-field location such that the on-field training session may be simultaneously viewed by a coach and player(s). The computer 304 is depicted in FIG. 3 for clarity of illustration. If the optional video recorder is employed, the force and motion data provided by each ISD 300, as well as the video data captured by recorder 308 may be loaded into the computer 304 via any suitable communications link, e.g., a RS-232 interface. Alternatively, the data may be streamed via a suitable communications protocol such as blue tooth.

Figure 4:
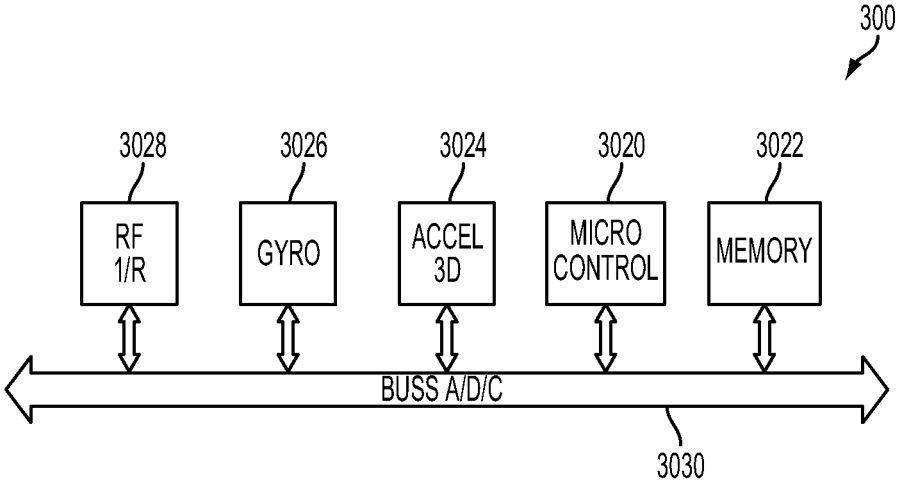
FIG. 4 schematically shows the components of an inertial sensor device (ISD; sensor) used in conjunction with the system depicted in FIG. 3.

The computer 304 will typically include a buss 3030 or other communication mechanism for communicating information and a processor 3020 coupled to the bus for processing information, as illustrated in FIG. 4. The computer system 304 also includes main memory 3022 such as a random access memory (RAM) or other dynamic storage device, coupled to the buss for storing information and instructions to be executed by the processor. Main memory can also be used for storing temporary variables or other intermediate information during execution of instructions by the processor 3020. The computer system 304 typically includes a read only memory (ROM) or other static storage device coupled to the buss for storing static information and instructions for the processor.

The computer system 304 may be coupled via the buss to a display 306, such as a cathode ray tube (CRT), liquid crystal display, active matrix display, or plasma display, for displaying information to a computer user. An input device 307, such as a keyboard including alphanumeric and other keys, is coupled to the buss for communicating information and command selections to the processor. Another type of user input device is a cursor control, such as a mouse, a trackball, or cursor direction keys, for communicating direction information and command selections to the processor and for controlling cursor movement on the display 306.

As noted above, the computer system 304 also includes one or more communication interfaces 3028 coupled to the buss. The communication interface provides a two-way data communication coupling to a network link connected to a local network. For example, the communication interface may be a digital subscriber line (DSL) card or modem, an integrated services digital network (ISDN) card, a cable modem, a telephone modem, or any other communication interface to provide a data communication connection to a corresponding type of communication line. As another example, communication interface may be a local area network (LAN) card (e.g. for Ethernet™ or an Asynchronous Transfer Model (ATM) network) to provide a data communication connection to a compatible LAN. Wireless links can also be implemented. In any such implementation, communication interface sends and receives electrical, electromagnetic, or optical signals that carry digital data streams representing various types of information. Further, the communication interface can include peripheral interface devices, such as a Universal Serial Bus (USB) interface, a PCMCIA (Personal Computer Memory Card International Association) interface, RS-232 interface, and etc.

The network link typically provides data communication through one or more networks to other data devices. For example, the network link may provide a connection through a local network to a host computer, which has connectivity to another network (e.g., a wide area network (WAN) or the global packet data communication network now commonly referred to as the "Internet") or to data equipment operated by a service provider. The local network and the exterior network may both use electrical, electromagnetic, or optical signals to convey information and instructions.

The term "computer-readable medium" as used herein refers to any medium that participates in providing data and/or instructions to the processor for execution. Such a medium may take many forms, including but not limited to non-volatile media, volatile media, and transmission media. Transmission media include coaxial cables, copper wire and fiber optics, including the wires that comprise the buss. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Referring again to FIG. 4, a diagrammatic depiction of an ISD 300 is disclosed in accordance with an illustrative embodiment of the invention. ISD 300 typically includes a microcontroller 3020, memory 3022, MEMS accelerometer 3024, MEMS gyroscope 3026, and RF interface 3028. Of course, the compact ISD 300 includes a battery (not shown) and a DC/DC converter (not shown) that converts the DC power provided by the battery to appropriate voltages required by the processor 3020 and the MEMS devices. ISD 300 is relatively compact and may be of the size of a matchbox. The microcontroller 3020 may be of any suitable type of microcontroller depending on the sampling rate of the MEMS sensors (3024, 3026) and other such factors. For example, the sampling rate of the system may be on the order of 1-1,000 msec. While the diagram of FIG. 4 shows the microcontroller 3020 and the memory 3022 as being separate devices, a microcontroller may be implemented as a single computer on a chip having RAM, ROM, clock, timers, and etc. on a single device. If the MEMS sensors provide analog data, an analog-to-digital converter may also be provided on-chip. Microcontroller 3020 may also be implemented using a microprocessor, an application specific integrated circuit (ASIC), or a field programmable logic device.

Figure 5A:
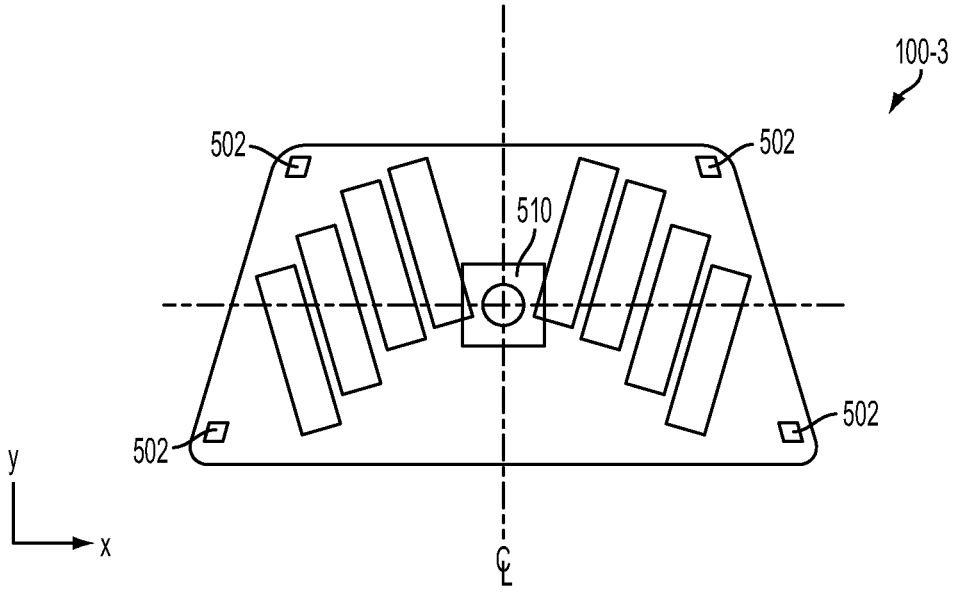
FIGS. 5*a*, 5*b*, respectively, show a is a front elevational view and a side view of a sports skills training apparatus system equipped with force transducers and sensors, and intended for training a single user, according to a non-limiting, exemplary embodiment of the invention.
Figure 5B:
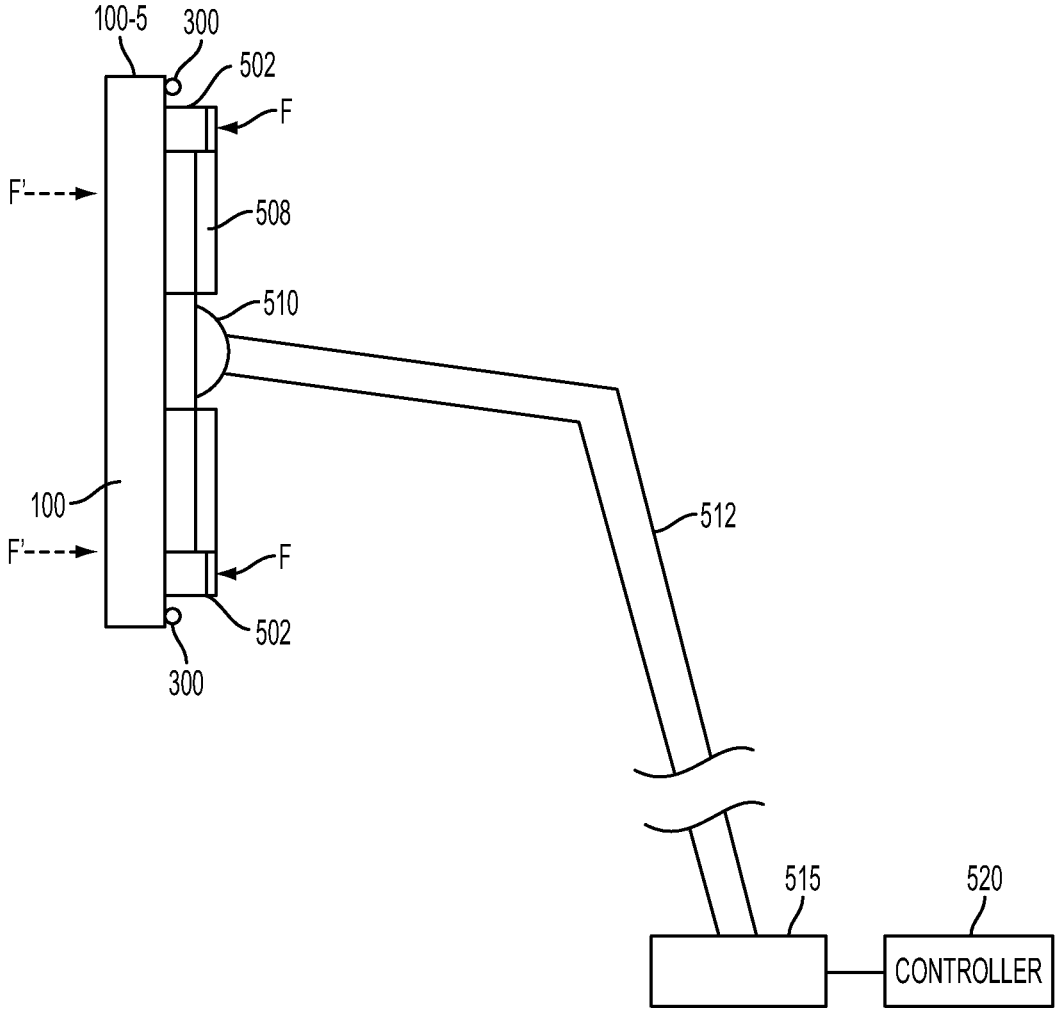

FIGS. 5*a*, 5*b* show another exemplary embodiment of the invention in which a sports skills training apparatus 100-5 includes a main body 100 as described herein above, which includes one or more force transducers 502 coupled to a backside surface of the main body 100 and attached to a back-plate structure 508. The apparatus 100-5 further includes a ball-socket or other type of multi-axes mount 510 further coupled to a support arm 512 and a base 515. Through a controller 520, instructions may be provided to the transducers 502 to exert various force values F against the body 100 over one or more selected time intervals. A responsive force F' provided by a user will be measured by one or more sensors 300 as described above and used in conjunction with system 1000 as appropriate. In an exemplary training scenario, a force F1 may be provided by transducer 502 over a steady-state time to train a response force F1'. Once the basic attributes of a desired response are known by the user, the force F1 may be changed in magnitude and/or duration to better train the response. This action may be programmed in a sequence that ultimately models a force and trained response in live action.

Figure 6:
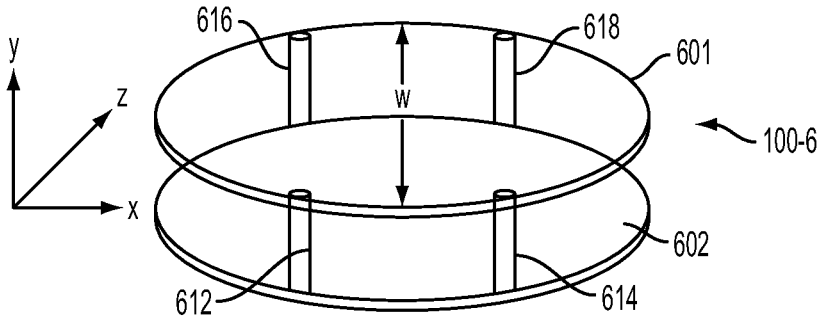
FIG. 6 shows a schematic perspective view of a sports skills training apparatus according to a non-limiting, illustrative aspect of the invention.

FIG. 6 shows a schematic perspective view of a non-limiting, exemplary aspect of the invention in which a sports skills training apparatus 100-6 includes two plate-like main body portions 601, 602, which are interconnected by two sets of handles 612, 614 and 616, 618. The width dimension, w, shown in the figure is exaggerated but would be dimensioned to provide appropriate spacing between a first user holding the apparatus by handles 612, 614 and a second user holding the apparatus by handles 616, 618.

Figure 7:
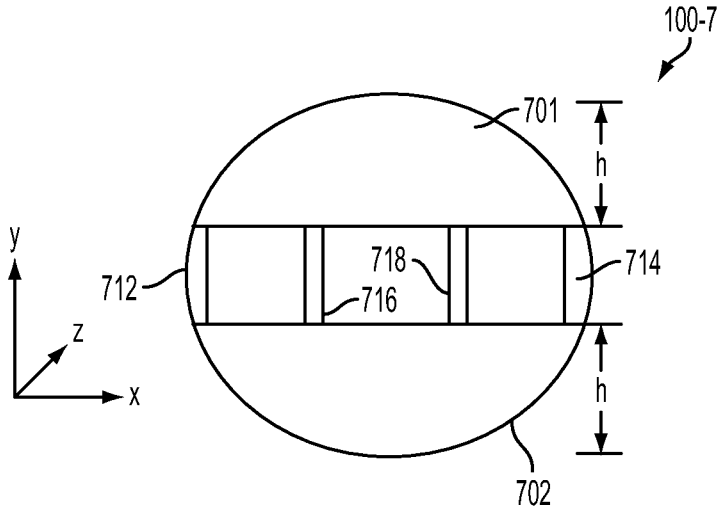
FIG. 7 shows a schematic front elevational view of a sports skills training apparatus according to a non-limiting, illustrative aspect of the invention.

FIG. 7 shows a schematic front elevational view of another non-limiting, exemplary aspect of the invention. The sports skills training apparatus 100-7 includes two D-shaped, plate-like main body portions 701, 702, which are interconnected at opposing flat edges by two sets of handles 712, 714 and 716, 718. The main body portions may be flat and thus lie in the x-y plane of the coordinate system, or may be curved in the ±z directions.

Figure 8:
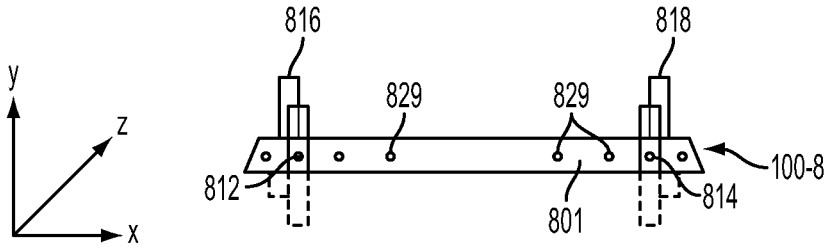
FIG. 8 shows a schematic perspective view of a sports skills training apparatus according to a non-limiting, illustrative aspect of the invention.

Another non-limiting, exemplary aspect of the invention is illustrated in FIG. 8, which shows a schematic perspective view of a sports skills training apparatus 100-8. Apparatus 100-8 includes a main body 801 in the form of a bar or tubular structure and two sets of handles 812, 814 and 816, 818. The main body may have a square, rectangular circular, oval, or other cross sectional shape. The handles may be removably attached to the main body with appropriate fasteners that pass through positioning holes 829 in the main body and attachment holes in each of the handles. The handles may extend upwardly or downwardly from a top or bottom longitudinal edge of the main body or may extend in both directions as indicated by the dotted lines. The main body may be straight or may have a curvature in the ±z directions. The main body may be constructed of one or more materials to allow twist action and beam flexure modes. It may be made with a graduated structure to change flexure as a function of handle position.

Figure 9:
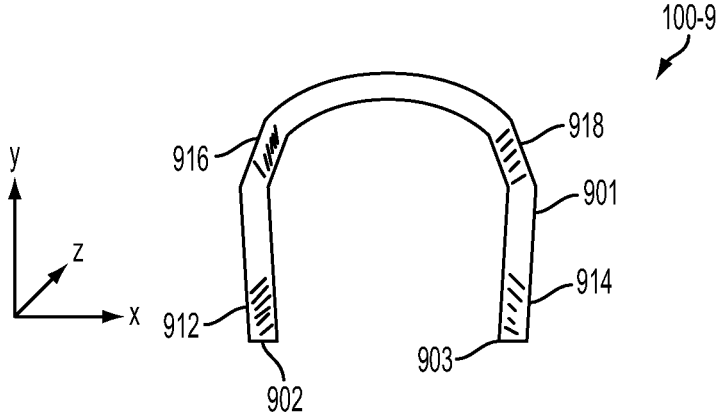
FIG. 9 shows a schematic front elevational view of a sports skills training apparatus according to a non-limiting, illustrative aspect of the invention.

FIG. 9 shows a schematic front elevational view of another non-limiting, exemplary aspect of the invention. The sports skills training apparatus 100-9 has a tubular construction and a horseshow-type shape. First and second user holding regions 912, 914 and 916, 918 are integral portions of the main body, as shown. They may be plain, textured, covered, or otherwise marked for identification, comfort, and functionality.

Figure 10:
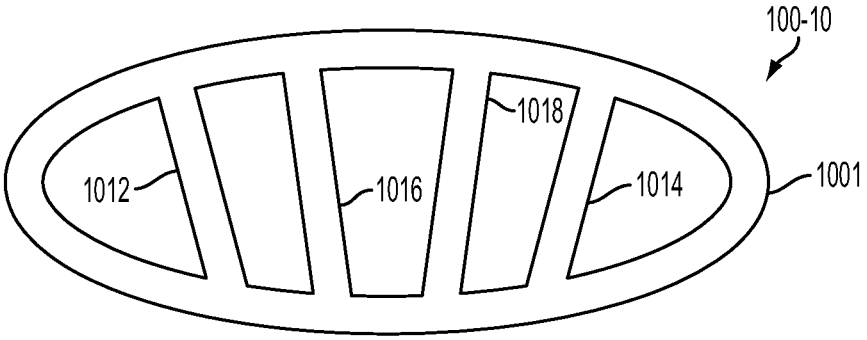
FIG. 10 shows a schematic front elevational view of a sports skills training apparatus according to a non-limiting, illustrative aspect of the invention.

FIG. 10 shows a further embodiment 100-10 in which the main body 1001 is formed into a looped bar 28 having (two or more) generally vertically-oriented handles 1012, 1014, 1016, 1018.

As referred to above and applicable to all of the aspects of the invention described herein, the main body and holding means/handles may be of similar or dissimilar materials, which may be selected for various attributes including apparatus strength, weight, rigidity or pliancy, specific training skill(s), apparatus complexity, apparatus form factor, and others. Handles and holding means may be shaped, sized, tapered, etc. to accommodate different sized hands/fingers, which may be taped, gloved or otherwise covered or uncovered. Materials that change color proportional to force/strain may be used as parts of the main body and or holding means, or in a tape form, for example, attached to various regions of the apparatus.

The use of the terms "a" and "an" and "the" and similar references in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. No language in the specification should be construed as indicating any non-claimed element as essential to the practice of the invention.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

I claim:

1. A physical skills training apparatus, comprising:

a one-piece main body having a front and an opposing back surface, the main body including eight vertically-disposed, elongate apertures disposed adjacent one another, wherein each two immediately adjacent apertures are separated by a section of the main body, further wherein four of the apertures are disposed on one side of a vertical centerline of the main body and the other four of the apertures are disposed on an opposite side of the vertical centerline of the main body, further wherein the immediately adjacent two apertures on a given side of the centerline provide a gripping, grasping or holding structure adapted for gripping, grasping or holding of the main body by a right or a left hand of a user positioned on a front-surface side of the main body and the other immediately adjacent two apertures on the given side of the centerline provide a gripping, grasping or holding structure adapted for gripping, grasping or holding of the main body by a respective left or right hand of a different user positioned on a back-surface side of the main body.

2. The apparatus of claim 1, wherein the opposing front and back surfaces of the main body are flat and parallel.

3. The apparatus of claim 1, wherein the four of the apertures on each side of the vertical centerline have a generally parallel orientation to each other.

4. The apparatus of claim 1, wherein the main body is curved and the opposing front and back surfaces are concentric.

5. The apparatus of claim 1, further comprising a passive sensor and a suitable power source engaged with at least one of the front surface and the back surface of the main body, wherein the sensor can provide an output data in response to an input from a user of the apparatus.

6. The apparatus of claim 5, further comprising a RF transmitter component operatively connected to the sensor, to wirelessly transmit the output data to a receiving component.

7. The apparatus of claim 1, further comprising:

a force-sensitive indicia attached to the apparatus.

8. The apparatus of claim 5, further comprising:

a support to which the main body is moveably mounted.

9. The apparatus of claim 8, further comprising:

a force transducer interconnected with the main body and the support assembly, such that a motion-inducing force can be provided to the main body by the transducer.

10. The apparatus of claim 9, wherein the force transducer is programmable to provide a plurality of different force values over respective time intervals.

11. The apparatus of claim 1, wherein the main body is characterized by a particular weight distribution associated with a particular skill to be trained.

12. A method for training physical skills, comprising:

providing the apparatus of claim 1;

engaging a trainee-user facing one of the front and the back surfaces of the main body via two of the immediately adjacent apertures on one side of the vertical centerline and two of the immediately adjacent apertures on the other side of the vertical centerline; and moving the apparatus from a respective back and front surface of the main body to elicit a physical motion response from the trainee-user according to the physical skill to be trained.

13. The method of claim 12, further comprising:

moving the apparatus in a desired way to elicit a desired physical response from the user.

14. The method of claim 12, further comprising:

mounting the apparatus to a structure and eliciting the physical response from the trainee-user.

15. The method of claim 12, further comprising:

detecting the physical response elicited from the trainee-user.

16. The method of claim 15, further comprising:

measuring a parameter of the response elicited from the user, including at least one of a response force vector component, a response time, a response time duration.

17. The method of claim 14, further comprising:

providing a force-producing component coupled to at least one region of the apparatus;

instructing the force-producing component to apply a given force; and detecting a response from a trainee-user.

18. The method of claim 17, further comprising:

i) providing one or more variable-force-producing components coupled to the apparatus;

ii) instructing the one or more variable-force-producing components to apply a first given force over a first given period of time;

iii) detecting a first response force by the trainee-user;

iv) determining whether the response force by the trainee-user meets a predetermined criteria and, if the predetermined criteria is not met, repeating steps (i-iv) or ending the process, or, if the predetermined criteria is met;

v) instructing the one or more variable force-producing components to apply another given force that is different than the first given force over a second given period of time that is equal to or less than the first given period of time;

vi) detecting a second response force by the trainee-user;

vii) determining whether the second response force by the trainee-user meets a second predetermined criteria and, if the second predetermined criteria is not met, repeating steps (v-vii) or ending the process, or, if the second predetermined criteria is met;

iterating the process with further different forces and shorter periods of time to train a desired user response with the apparatus.

* * * * *